United States Patent [19]

Graninger et al.

[11] 4,250,477

[45] Feb. 10, 1981

[54] MECHANICAL LATCH APPARATUS

[75] Inventors: Frank J. Graninger, Milwaukee; Robert J. Frey, Greendale, both of Wis.

[73] Assignee: Allen-Bradley Company, Milwaukee, Wis.

[21] Appl. No.: 938,649

[22] Filed: Sep. 7, 1978

[51] Int. Cl.[3] ..... H01H 9/20; H01F 7/08

[52] U.S. Cl. ..... 335/169; 335/170; 335/263

[58] Field of Search ..... 335/21, 22, 38, 132, 335/167, 168, 169, 170, 171, 261, 263, 266, 279

[56] References Cited

U.S. PATENT DOCUMENTS

| | | | |
|---|---|---|---|
| 2,479,320 | 8/1949 | Cumming et al. | 335/169 X |
| 2,939,055 | 5/1960 | Gebhart | 335/266 |
| 3,043,995 | 7/1962 | Cassell | 335/266 X |
| 3,358,252 | 12/1967 | Hermann et al. | 335/170 |
| 3,364,450 | 1/1968 | Conner | 335/170 |
| 3,394,328 | 7/1968 | Morrell et al. | 335/167 |
| 3,503,021 | 3/1970 | DeBruin et al. | 335/254 |
| 4,087,770 | 5/1978 | Kuhn et al. | 335/132 |

*Primary Examiner*—Fred L. Braun
*Attorney, Agent, or Firm*—Quarles & Brady

[57] ABSTRACT

A mechanical latch attachment (20) for a control relay (21) includes a mechanical latch movement (77), a solenoid (49), and a pair of contact cartridges (33) that are disposed in a housing (25). The wear-resistant latch movement (77) has a latch (95) with teeth (103) on one end that are engaged by a pair of pivotable, hooked pawls (105). The latch (95) is coupled to an operating plunger (79) through a contact actuator (82). The operating plunger (79) can be coupled to a conventional control relay (21), which moves the plunger (79) upon the closing of its relay armature (30) to actuate the contacts (35, 36) in both the relay (21) and the attachment (20) and to move the latch (95) to a position where it is restricted by the pawls (105). The restriction of the latch (95) holds the relay armature (30) closed and the contacts (35, 36) actuated even though the relay (21) is deenergized. The solenoid (49) has an armature (62) that can be moved mchanically or electrically to release the latch (95) from the pawls (105). A high-compression spring (89) coupling the plunger to the contact actuator (82), protects the latch movement (77) from shock forces that might be encountered during shipment or abnormal handling. Relays with a mechanical latch attachment provide quiet operation and retain their operated state even in the event of a power failure.

12 Claims, 11 Drawing Figures

127
126
126
125
86
116
76
128
36
118
37
76
38
38
35
40
35
36
33
34
41
39
25
20
87
68
119
77
78
121
45
46
121
37
38
38
41
33
40
34
35
36
36
35
23
43
42
31
30
24
28
21
22
129
27
129
32

Fig. 5
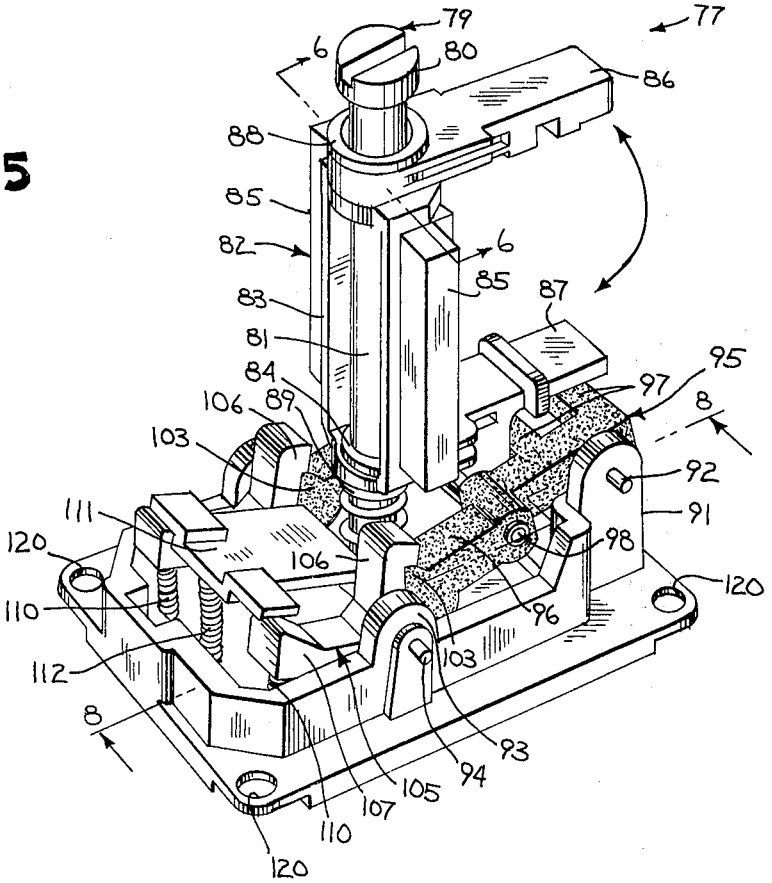
Fig. 10
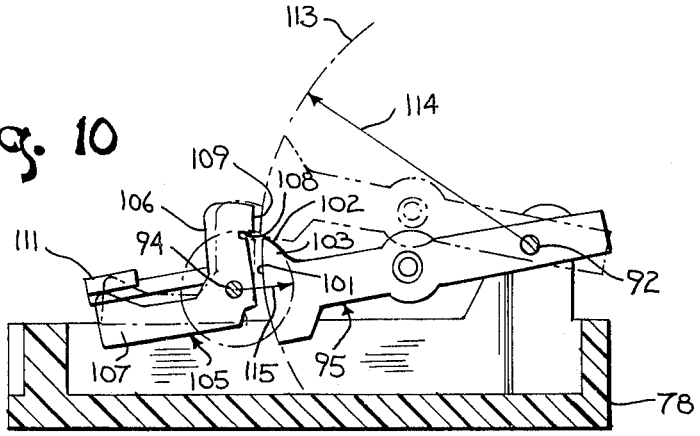
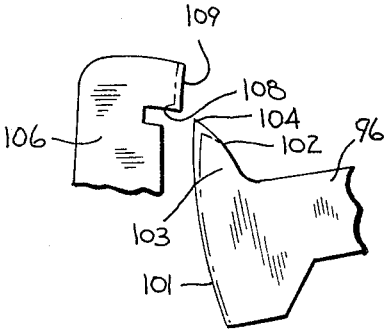
Fig. 11

MECHANICAL LATCH APPARATUS

TECHNICAL FIELD

The invention relates to mechanical latch relays having a primary electromagnet that is momentarily energized and mechanically latched upon its energization, to maintain the actuation of switch contacts coupled to it, and a secondary electromagnet that is momentarily energized to unlatch the relay and cease actuation of the switch contacts.

BACKGROUND ART

Mechanical latch relays are usually employed where it is desired to initially operate the relay contacts by energizing an associated electromagnet, and then retaining the contacts in their operated state with a mechanical latch. The electromagnet can then be deenergized and there is no power consumption during the period of operation. When it is desired to restore the relay contacts to their initial, unoperated state, a secondary electromagnet is energized to trip the mechanical latch.

Mechanical latch relays are particularly suitable for controlling apparatus that is run continuously over long time periods, such as fans and pumps. The apparatus can be run without requiring constant electrical operation of the primary electromagnet in the relay.

These latching relays also provide a memory function for control circuits. Where a number of relays are employed in a control circuit, the probabilities at any given moment are that some of the relays are energized and "closed," and some of the relays are deenergized and "open". In the event of an interruption, a power failure for example, it is sometimes desired to maintain the relays in the open or closed state which they were in prior to the interruption. This simplifies restarting the controlled apparatus because it eliminates the need to reset relays to obtain a particular operating point in the control cycle.

Still another application for these latching relays is in areas where low noise levels must be maintained. If the hum or chatter of an energized electromagnet is objectional, a mechanically-held relay is sometimes the solution to the noise problem.

The mechanical latch structure of these relays usually is an accessory or adjunct to an electromagnetic relay of standard design. By attaching the mechanical latch structure, the conventional relay is converted to a mechanical latch relay. As an attachment, the mechanical latch mechanism provides increased versatility to an existing electromagnetic relay.

Because a mechanical latch device is usually an attachment for an existing electromagnetic relay, it should be compatible with this relay. It should also be interchangeable with other attachments for the relay. For example, a timer attachment that provides time delayed switch operation may be another attachment for the basic relay, so that either the mechanical latch attachment or the timer attachment may be mounted to the basic relay to provide the desired optional features. The mechanical latch attachment and the timer attachment should preferably be mounted on, and connected to, the basic relay in a similar manner. It would also be preferable to have a mechanical latch attachment and a timer attachment with common and interchangeable subassemblies and parts, to simplify manufacture of the two devices.

The known prior art does not disclose a mechanical latch mechanism that has subassemblies and components that are common to, and interchangeable with, the subassemblies and components of a timer mechanism. Another characteristic of the prior devices is an integral construction in which it is inconvenient to remove some components for inspection or servicing.

Because the latch mechanism in a mechanical latch relay may be operated many thousands of times, the latch mechanism must be resistant to wear that would impair its ability to latch. Several prior art devices have employed latch mechanisms that are constructed with hardened metal parts. These metal parts are relatively expensive to manufacture in comparison with parts that can be molded from thermoplastic resinous materials or other non-metallic materials. A problem in producing a latch mechanism with molded plastic parts has been providing the service life and smooth operation that is required in an industrial control relay. One prior device with a non-metallic latch mechanism includes a latch and a catch with squared-off corners on their mutually engaging surfaces. These corners, however, tend to become rounded after a moderate number of operations, thereby increasing the opportunity for a failure or miss by the latch mechanism.

Mechanical latch relays, like other relays, are often mounted in control panels and relay banks where mounting space is limited, and it is therefore important that requirements for additional mounting space for the mechanical latch mechanism be minimized. Because mechanical latch mechanisms include secondary electromagnets, more compact devices are not easily obtained. Prior mechanical latch relays have been assembled in at least two general configurations. In one configuration, a mechanical latch attachment is stacked on top of the control relay and fastened to it, the control relay forming a base for the mechanical latch attachment. In another configuration, the mechanical latch mechanism is mounted to the side of a portion of the relay that houses the primary electromagnet. This side by side configuration presents a disadvantage where mounting space for the relay is limited.

In some applications, a latching relay should be capable of both manual and electrical operation to both close and open a circuit. In other applications, manual operators are important because they allow the relay to be periodically tested. These manual operators should be easy to reach and operate when the relay is mounted in a control panel or relay bank. It is not believed that any of the devices of the "stack" configuration mentioned above include both a manual latching operator and a manual release operator located on a top or forward portion, and operable with a pushing or depressing motion.

DISCLOSURE OF THE INVENTION

The invention resides in a mechanical latch device having a housing, a set of contacts adapted to be disposed in the housing, and a mechanical latch movement adapted to be disposed in the housing. The mechanical latch movement includes an operating plunger adapted to be operatively coupled to the contacts and adapted to be moved longitudinally to and from a position in which the contacts are actuated, a latch adapted to be operatively coupled to the plunger for movement therewith, and catch means for releasably restricting the latch when the plunger is moved to its contact-actuating position. An electromagnet is adapted to be supported by the housing and has an armature that is adapted to move the catch means and release the latch, to allow the plunger to be moved away from its contact-actuating position.

The mechanical latch device can be mounted on a relay of conventional design. Through its operating plunger the relay movement can be coupled to an armature and contacts in a base relay. The relay movement becomes latched when the base relay is energized to hold the armature and its associated contacts in a closed position, even though the relay is soon deenergized.

More specifically, the mechanical latch movement includes an elongated operating plunger that is longitudinally movable between first and second positions, and a latch on which a pair of projecting engagements are formed. Connection means are fastened to the plunger and coupled to the latch, for moving the latch with the plunger, between first and second latch positions corresponding to the first and second positions of the plunger. Also included in the latch movement are a pair of catches, each having a hooked end that is adapted to move along an arcuate path to and from a position where the hooked end restricts a respective latch engagement when the latch is moved to its second latch position by the plunger.

The invention provides a wear-resistent latch mechanism. The projecting latch engagements and the hooked ends of the catches cooperate to provide a secure mating connection. The latch can be disengaged by operating the catches to slide the hooked ends off the latch engagements along the arcuate path. The latch engagements provide a source of excess material that can be worn away without impairing the operation of the latch mechanism. In a prior art arrangement with squared-off corners, the latch mechanism could be affected by a relatively smaller amount of wear on its latch and the catch.

The advantages of the invention can be extended by forming the latch engagements in the shape of teeth, each tooth being formed with converging convex surfaces. The catches are adapted to slide on a front convex surface of each latch tooth when the plunger is in its first position, and are further adapted to engage a back convex surface of each latch tooth upon the movement of the plunger to its second position. A further reduction of wear can be achieved with a latch that is made of an acetal resin and catches that are made of nylon. The combination of these materials provides a lower coefficient of friction between two mutually engaging surfaces, than would be available with many other materials.

The relay movement of the present invention has some components that can be used in a relay movement for a time delay relay, such as described in U.S. Pat. No. 4,179,676, which issued Dec. 18, 1979, which is assigned to the assignee of the present invention, and which is entitled "Time Delay Relay Movement". In the present invention the means for connecting the latch to the operating plunger is fastened to the plunger, rather than coupled to it with a lost motion connection as in a time delay relay. In the present arrangement the position of the relay armature and the actuation of contacts in all sections of the mechanical latch relay can be controlled by controlling the latch. In the copending patent application mentioned above, the position of the latch controls only the actuation of the time delayed switch contacts. In the mechanical latch relay movement, a pair of catches are adapted to restrict the latch on opposite sides of the operating plunger to provide balanced restraining forces. The dual engagement of the latch by the catches also doubles the area of the latch engagement surfaces, and reduces the pressures that cause wear thereon. In the time delay relay movement, the latch is restricted by only one catch at a time.

Another aspect of the present invention is the combination of a contact-actuating, mechanical latch relay movement, a secondary electromagnet and some auxiliary contact cartridges, all in a single housing. Due to a compact arrangement of the electromagnet on one side of the plunger, there is space in the housing for auxiliary contact cartridges on the other side of the plunger. The connection means that is fastened to the plunger and coupled to the latch may be a contact actuator for operating the auxiliary switch contacts. The contact actuator is disposed between the secondary electromagnet and the auxiliary contact cartridges, and couples the auxiliary switch contacts to the primary electromagnet in the base relay. Thus, the mechanical latching device of the present invention provides the option of adding to the number of contact cartridges controlled by the base relay. Although the invention is disclosed in conjunction with a simple control relay, the invention may also be applicable to contactors and other electromagnetic switching devices in addition to the simple control relay described herein.

The invention further includes a compact secondary electromagnet that fits in a compartment in the housing that is also suitable for receiving a pneumatic timer of type disclosed in U.S. Pat. No. 4,179,676, referred to above. The electromagnet has a yoke-and-coil assembly that is partially encapsulated in a block of insulating material having a passageway therethrough. The electromagnet also includes an armature having a depending portion that is made of non-ferromagnetic material. The depending portion of the armature extends through the passageway and outside the insulating block. This depending portion provides a mechanism for releasing the catches upon the energization of the yoke-and-coil assembly. The depending portion of the armature and the passageway are formed with corresponding segments that are rectangular in cross section to prevent the armature from rotating. Due to the compactness required of the electromagnet, magnetic strips are disposed inside a cover for the electromagnet and above the armature to hold the armature in its open position without significantly contributing to the forces opposing the closure of the armature at other positions.

The armature of the secondary electromagnet also functions as a manual release operator, which is accessible through an aperture in the electromagnet cover. The secondary electromagnet is disposed in the housing so that the armature is aligned for movement parallel to the operating plunger, which is the manual operator for latching the relay. Thus, the mechanical latch device includes a pair of manual operators that are operated in the same direction to latch and unlatch the mechanical latching device.

Another aspect of the invention arises from the fact that the latch components, being made of non-metallic materials, are relatively lightweight in comparison with the electromagnet in a control relay that is coupled to it through the operating plunger. It may sometimes be desirable to ship the mechanical latch device of the present invention in coupled connection with a control relay of a type described herein. If shock forces are applied to the coupled units during transportation or other handling, it might be possible for the armature in the control relay to open with such force as to damage the components of the mechanical latching device. A further aspect of the invention is the provision of a high-compression spring connected between a flange formed on the operating shaft and one end of the contact actuator. In normal use, this high-compression spring acts as a rigid member in transmitting motion between the operating shaft and the contact actuator. However, in the unusual situation discussed above, the high-compression spring will yield upon the forceful opening of the armature in the primary electromagnet, to absorb a part of the force resulting therefrom, and protect the latching components from damage.

It is one object of the invention to provide a latch movement in a compact, one-piece subassembly that can be easily assembled and disassembled as part of a relay, and easily interchanged with like subassemblies or with subassemblies that convert the relay to other uses.

It is another object of the invention to provide a mechanical latch relay with a latch mechanism that has improved resistance to wear.

It is another object of the invention to provide a mechanical latch relay movement that is suitable for use with latch components made from thermoplastic resinous materials.

It is another object of the invention to provide a mechanical latch movement in a latching device that increases the contact cartridge capacity of the relay.

It is another object of the invention to provide a compact solenoid as a secondary electromagnet that can be operated either manually or electrically to unlatch the relay movement.

It is another object of the invention to protect the latch components from possible damage during shipment.

The foregoing and other objects and advantages will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

BRIED DESCRIPTION OF THE DRAWINGS

FIG. 5 is a perspective view of the relay movement assembly that forms a part of the mechanical latch device of FIG. 1;

FIG. 10 is a detail view of the latch mechanism taken in the same plane as FIGS. 8 and 9 to show important relationships in the cooperation of its parts; and FIG. 11 is an enlarged profile of the tip of the latch with phantom lines to show the manner in which it wears.

BEST MODE FOR CARRYING OUT THE INVENTION

Figure 1:
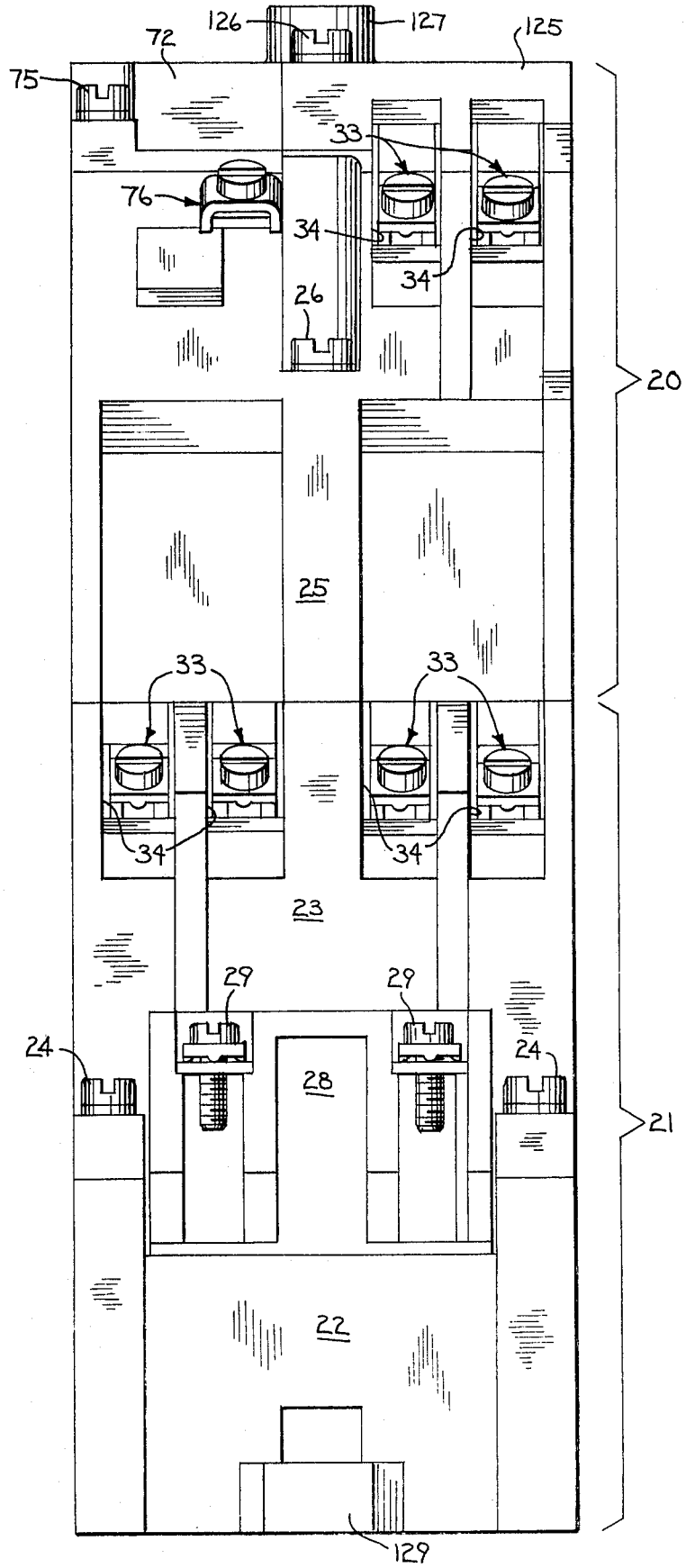
FIG. 1 is a side view in elevation of a mechanical latch device that embodies the present invention and that is mounted on top of a conventional control relay to form a mechanical latch relay.
Figure 4:
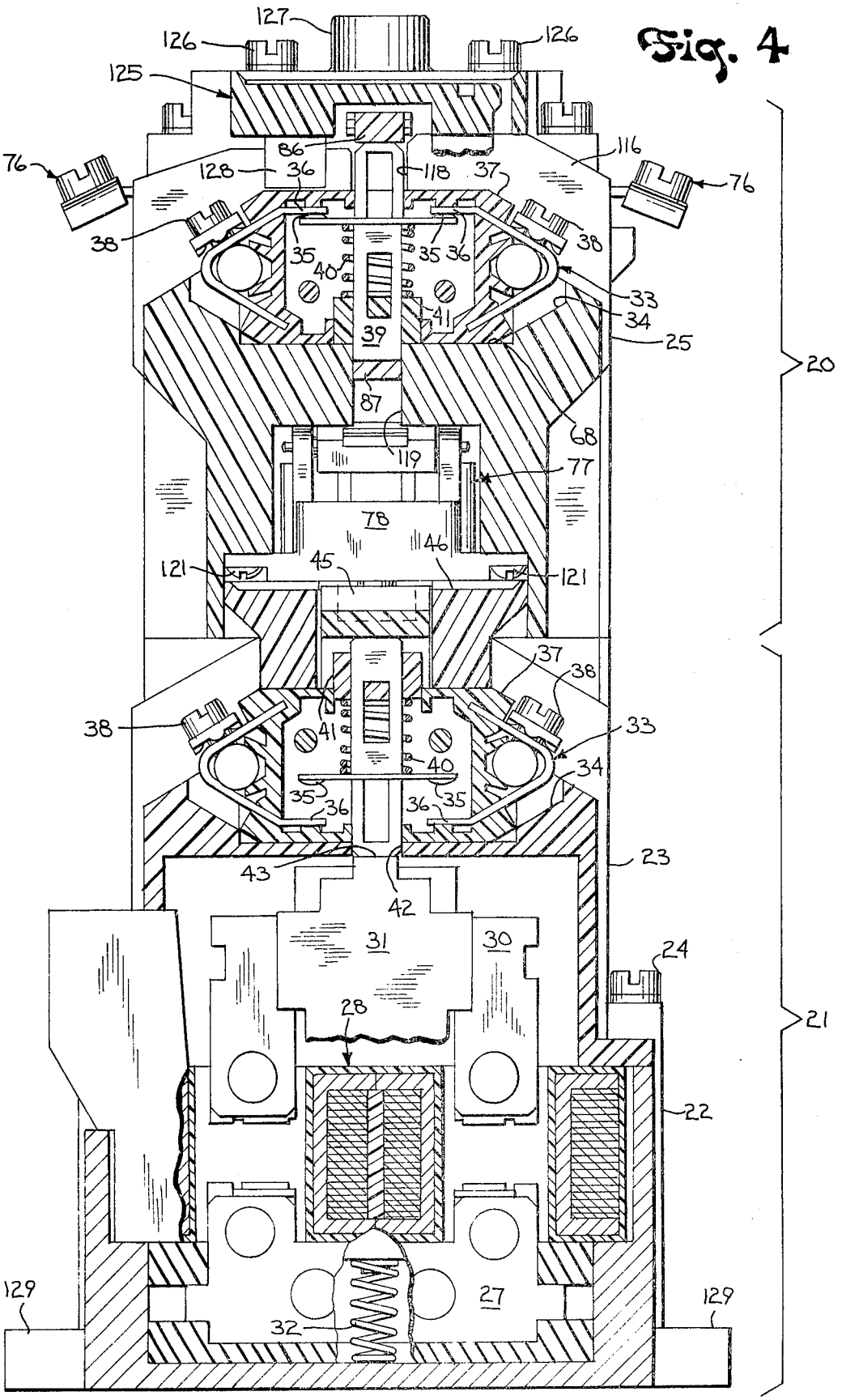
FIG. 4 is a sectional view taken in the plane indicated by lines 4—4 in FIG. 2.

In FIGS. 1 and 4 a mechanical latch device 20 that embodies the present invention is mounted on a conventional control relay 21 to provide a mechanical latch relay. The control relay 21 is housed in a two-part enclosure formed by a magnet housing 22 and a lower contact cartridge housing 23 that is fastened at its corners to the magnet housing 22 with mounting screws 24. The mechanical latch device 20 is housed in an upper contact cartridge housing 25 that has been modified to hold other subassemblies of the invention in addition to contact cartridges. The modified, upper contact cartridge housing 25 is fastened to the lower contact cartridge housing 23 by mounting screws 26 located at intermediate points along the front and back sides of the housings 23, 25.

A control relay 21 that is suitable for use with the apparatus of the present invention is disclosed in Kuhn et al, U.S. Pat. No. 4,087,770, issued May 2, 1978, and assigned to the assignee of the present invention. To facilitate an understanding of the operating environment of the present invention, portions of that relay are also shown and described as the control relay 21 of the present application, although the control relay 21 does not form a part of the present invention.

The control relay 21 includes the to basic elements of a relay, namely an electromagnet and contacts that are coupled to the electromagnet to provide an electromagnetic switch. More particularly, the electromagnet, which is shown in FIG. 4, includes a two-legged yoke 27 secured in the magnet housing 22. An energizing coil assembly 28 encircles the legs of the yoke 27 and forms two vertical openings in which the legs of the yoke 27 are received from the bottom. The coil assembly 28 is held in place by the lower cartridge housing 23, which is fastened down upon it. The coil assembly 28 can be energized through a pair of terminals 29, seen in FIG. 1, on a portion of a coil assembly casing that extends outside the magnet housing 22.

A movable armature 30 has two depending legs that are received in the coil assembly openings from the top, the armature legs having pole faces formed on their downward facing ends. These pole faces are opposed by pole faces formed on the upward facing ends of the yoke legs. The armature 30 is supported within the lower cartridge housing 23 for reciprocal, vertical motion by a plastic drive yoke 31. The drive yoke 31 has a pair of legs depending into the magnet housing 22 in front and back of the armature 30, the front leg being seen with a portion broken away in FIG. 4. The legs of the drive yoke 31 are supported by armature return springs 32, which are captured between the bottom ends of the drive yoke legs and the magnet housing 22.

In FIG. 4, the armature 30 is shown in its open position with its pole faces spaced apart from the opposing pole faces of the yoke 27.

The control relay 21 also includes contact cartridges 33 that are housed in the contact cartridge housing 23 above the electromagnet. The lower catridge housing 23 is made of a resinous thermoset insulating material molded in a complex shape. As seen in FIG. 1, the lower cartridge housing 23 has four compartments 34 formed between two vertical outer walls by spaced, vertical ribs. Each compartment 34 holds a modular contact cartridge 33, such as that disclosed in Kuhn, U.S. Pat. No. 3,995,932, issued Dec. 7, 1976. As seen in FIG. 4, each modular switch cartridge 33 has a pair of movable contacts 35 that oppose a pair of stationary contacts 36 within a plastic case 37. The stationary contacts 36 are bent strips of metal that extend to opposite ends of the case 37 where a pair of terminals 38 are connected to them. The movable contacts 35 are carried by an operating stem 39 that slides longitudinally up and down through the case 37. A contact spring 40 is mounted on the operating stem 39 between the movable contacts 35 and a spring stop 41 fastened to one end of the operating stem 39.

Each contact cartridge 33 is disposed in its compartment 34 with the bottom of its case 37 resting on a floor formed in the compartment 34. The lower end of the operating stem 39 extends through an opening 42 in the floor of the cartridge compartment 34, and rests on one of a pair of shoulders 43, which are formed on the drive yoke 31, and which extend transversely across the top of the armature 30 from front to back. The drive yoke 31 also has a centrally disposed, vertical neck 44 that extends upward, the upper portion being visible in FIG. 8. A cross bar 45 is mounted on top of the neck 44 and extends horizontally across the tops of the cartridge compartments 34 to trap the operating stems 39 of the contact cartridges 33 between it and the shoulders 43 of the drive yoke 31, as seen in FIG. 4. The entrapment of the operating stems 39 provides part of the "positive drive" operation of the contacts 35, 36 to be described more fully below. The cross bar 45 and the upper ends of the operating stems 39 are also disposed in a central opening in a cover 46. As the operating stems 39 are moved, the cartridge cases 37 are held in place by portions of the cover 46 that depend into the contact cartridge compartments 34 on opposite sides of the operating stems 39.

By turning the contact cartridge 33 upside down in the contact cartridge compartment 34, thereby reversing the ends of the operating stem 39, the movable contacts 35 can be positioned for normally closed operation. The spring stop 41, being wider than the opening 42 in the floor of the compartment 34, would then rest on the floor to position the movable contacts 35 for normally closed operation.

From this description it can be seen that the drive yoke 31 and the cross bar 45 form a contact actuator that operates the contacts 35, 36 in response to the closing and opening of the electromagnet. In the well known operation of the electromagnet, the coil assembly 28 is energized through its terminals 29 to induce an electromagnetic force that pulls the armature 30 downward and closes its pole faces against the pole faces of the yoke 27, thereby compressing the armature return springs 32. The downward movement of the armature 30 will positively drive the operating stem 39 in the lower contact cartridge 33 in FIG. 4 downward to close the relay contacts 35, 36. Upon the deenergizing of the coil assembly 28, the electromagnetic force is removed, and the armature 30 is allowed to move to its open position shown in FIG. 4, under the urging of the return springs 32. The upward movement of the armature 30 will positively drive the same operating stem 39 upward to open the relay contacts 35, 36.

Figure 2:
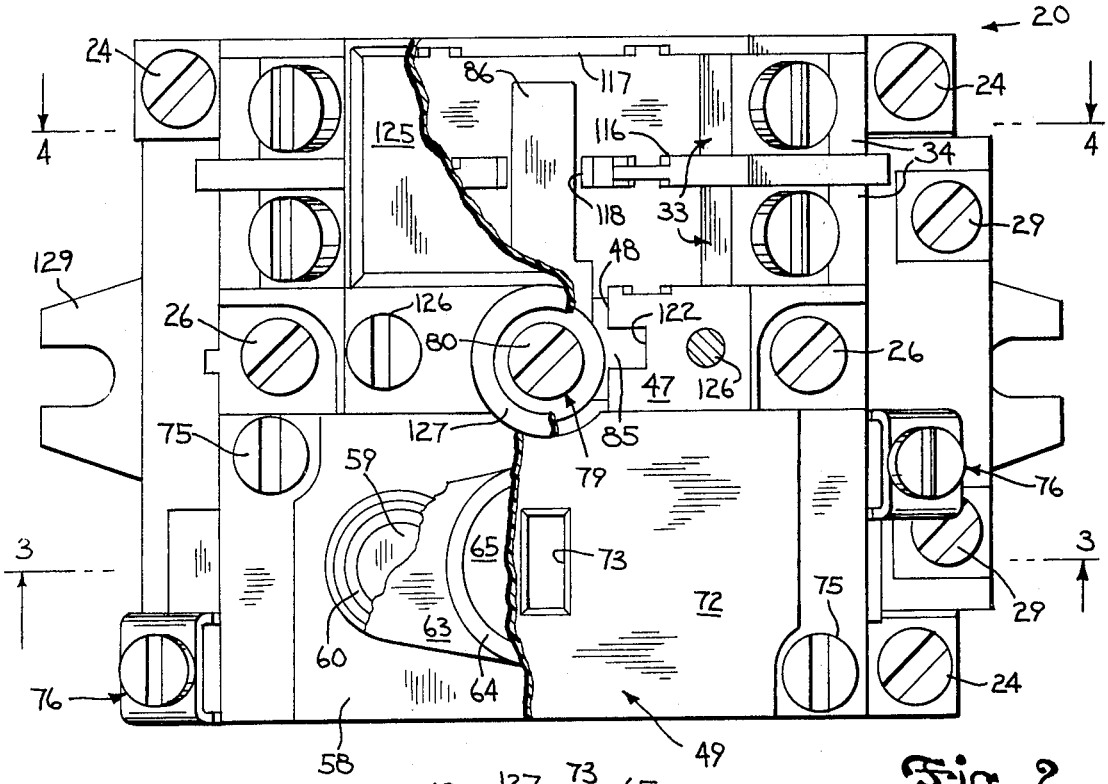
FIG. 2 is a top view of the mechanical latch relay of FIG. 1 with parts of two top covers broken away to show two contact cartridges and details of the solenoid.
Figure 3:
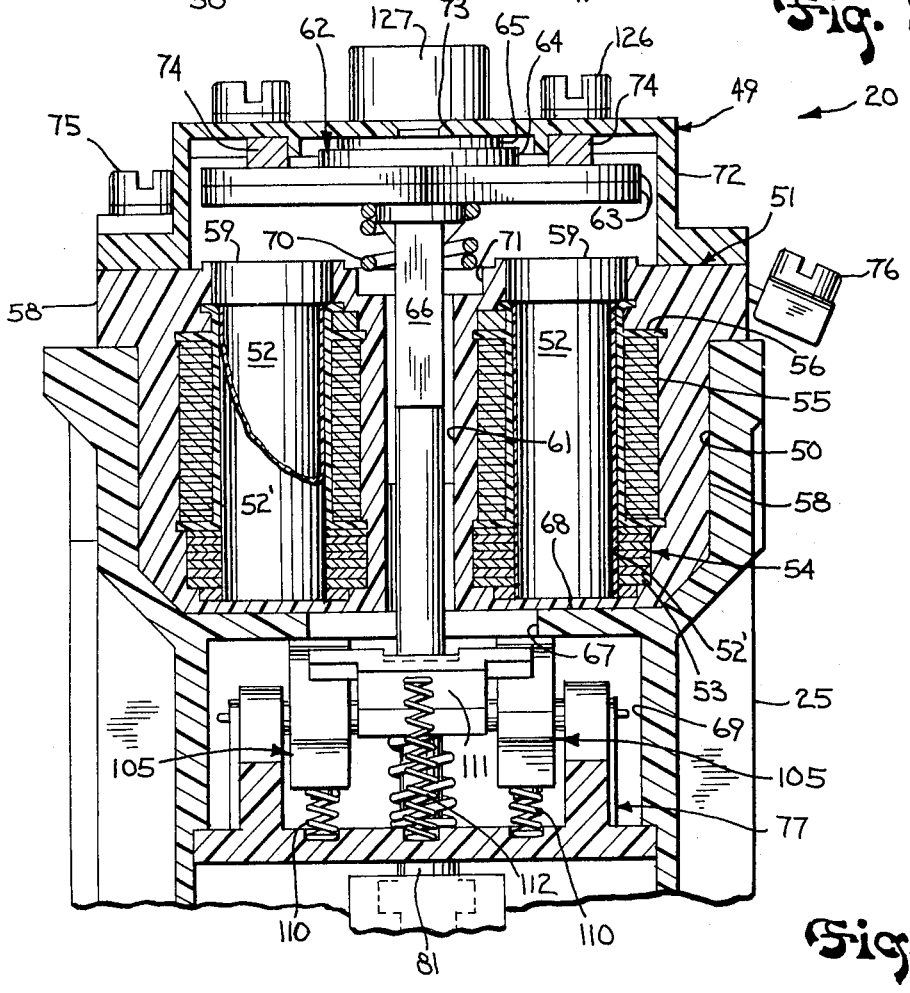
FIG. 3 is a sectional view of the top portion of the mechanical latch relay taken in the plane indicated by lines 3—3 in FIG. 2.
Figure 7:
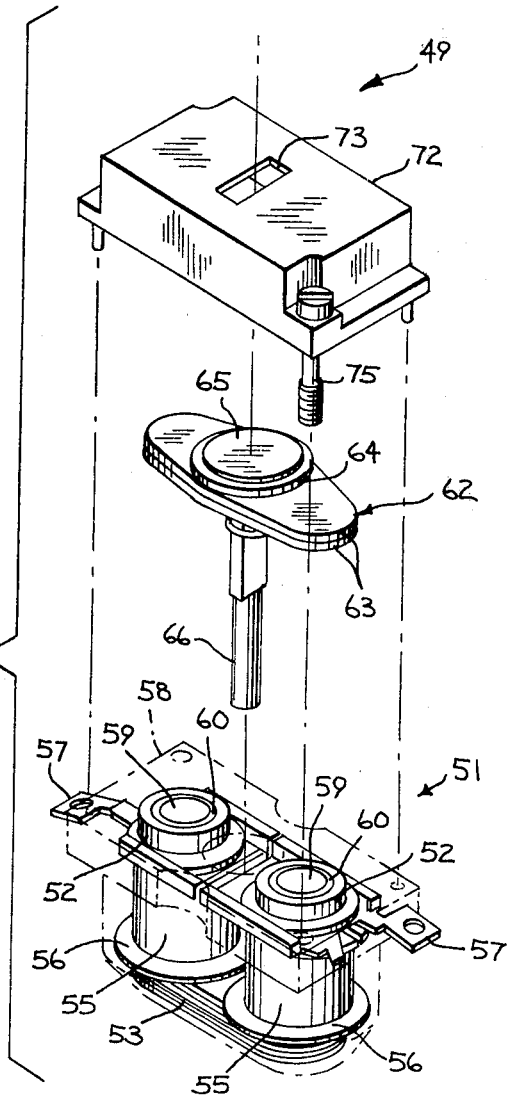
FIG. 7 is an exploded view in perspective of the solenoid that forms a part of the mechanical latch device shown in FIG. 1.

Referring again to FIG. 1, the upper contact cartridge housing 25, which houses the apparatus of the present invention, is made of a resinous thermoset insulating material that is molded in a complex shape. The upper cartridge housing 25 is capable of serving as the housing for time delay device disclosed in U.S. Pat. No. 4,179,676, mentioned above. Referring to FIG. 2, the upper cartridge housing 25 is divided into two sections by a central longitudinal rib 47, which is relatively thick, and which has a vertical, central opening 48 in it. On one side of the central rib 47 a solenoid 49 is mounted within a solenoid compartment 50, as seen in FIG. 3. The solenoid 49 has an energizing section 51, an armature 62, and a cover 72, which are shown in FIG. 7, and which can be dropped in, or removed from, the solenoid compartment 50 as a unit. The solenoid compartment 50 is of the same shape as the timer compartment in the copending application mentioned above. This allows the solenoid 49 to replace a pneumatic timer in a time delay relay as part of the conversion of that relay to a mechanical latch relay.

Referring to FIGS. 3 and 7, the solenoid energizing section 51 includes a pair of spaced, magnetic steel legs 52 of circular cross section that are joined together by a plurality of laminated plates 53 of ferromagnetic material to form a U-shaped yoke 54. The legs 52 pass through holes of slightly larger cross section and sleeves 52′ of heat-shrinkable material are each disposed around a respective leg 52 to form a permanent air gap between the legs 52 and the laminated plates 53. The thickness of each sleeve 5 is exaggerated in FIG. 3 to better illustrate this part of the solenoid 49. A pair of coils 55 are each wound on a bobbin 56 of insulating material that fits around a respective leg 52. The coils 55 are connected in series, each coil 55 also being connected to a terminal plate 57, which fits partly around the top end of the leg 52 encircled by its associated coil 55. The yoke 54 is encased in a block of insulating material 58, except for the upwardly facing ends of the yoke legs 52, which form pole faces 59. A shading ring 60 is embedded in each pole face 59 as seen in FIG. 2. The insulating block 58 has a vertical passageway 61 formed between the two yoke legs 52, as seen best in FIG. 3, the passageway 61 passing through the laminated plates 53. The upper portion of the vertical passageway 61 is rectangular in cross section, while the lower portion is circular in cross section for reasons soon to become apparent.

Referring again to FIG. 7, T-shaped armature 62 for the solenoid 49 is formed of a pair of flat, horizontally extending, oblong plates 63 and a flat, circular plate 64 stacked on top of the oblong plates 63. A colored vinyl disk 65 is attached to the top of the circular plate 64. An armature shaft 66 of lightweight, non-ferromagnetic material depends from the oblong plates 63. The armature shaft 66 has an upper portion of rectangular cross section and a lower portion of circular cross section. As seen in FIG. 3 the armature shaft 66 is received in the passageway 61 and extends through an opening 67 in a horizontal partition 68, which separates the solenoid compartment 50 from a chamber 69 formed beneath it in the upper cartridge housing 25. The corresponding rectangular portions of the armature shaft 66 and the passageway 61 prevent the armature 62 from rotating. The armature shaft 66 has a portion adjacent to the oblong plates 63 with an enlarged circular cross section to hold the upper end of an armature return spring 70 above a seat 71 formed at the upper end of the passageway 61.

As seen in FIGS. 3 and 7, the solenoid 49 also has a solenoid cover 72 that fits over the unencapsulated end of the solenoid yoke 53 to partially enclose the solenoid armature 62. The solenoid cover 72 has a centrally located, rectangular aperture 73, shown best in FIGS. 2 and 7, which is positioned over the armature shaft 66 and aligned with longitudinal axis thereof, as seen in FIG. 3. The colored vinyl disk 65 on top of the armature 62 is a visual indicator of the point of manual operation, the indicator being visible through the solenoid cover aperture 73. A pair of magnetic strips 74 are mounted to the inside top portion of the solenoid cover 73 and above the solenoid armature 62. These strips 74 are made of an elastomeric material that has magnetized particles suspended in it. These strips 74 provide an upward attractive force which counteracts vibrations and holds the solenoid armature 62 in an open position when the solenoid 49 is deenergized.

The solenoid 49 is mounted in the solenoid compartment 50 with mounting screws 75, seen in FIGS. 2 and 7, which extend through the solenoid cover 72, and through a rim around the top of the insulating block 58, and into the upper cartridge housing 25, to hold the solenoid 49 in the position shown in FIGS. 2 and 3. Terminals 76 are mounted on opposite ends of the solenoid 49 to ends of the terminal plates 57 that extend outside the insulating block 58.

In operation, the solenoid coils 55 are energized through these terminals 76 to induce an electromagnetic force between the armature plates 63, 64 and the pole faces 59 of the yoke 53. This causes the armature plates 63, 64 to close against the pole faces 59 and the armature shaft 66 to move longitudinally downward through the opening 67 in the partition 68. The distance traveled by the armature 62 in this closing movement is relatively short due to the small amount of space in the mechanical latch device 20 that is allotted to the solenoid 49. As the armature 62 is closed, the force provided by the magnetic strips 74 drops off rapidly, while the return spring 70 is moving towards the seat 71. The return spring 70 does not become a load on the solenoid 49 until it is captured and stressed between the oblong plates 63 and the seat 71. The magnetic strips 74 provide a holding force without adding a significant load on the solenoid 49, which allow for the small size of the solenoid 49.

Upon deenergizing of the solenoid coils 55, the armature 62 moves upward under the urging of the armature return spring 70. As the return spring 70 extends upward, its spring force is decreased in proportion to the distance of its extension from its compressed position. At the same time the distance between the strips 74 and the armature 62 decreases, and the attractive force exerted on the armature 62 by the magnetic strips 74 increases. In the fully open position the attractive force provided by the magnetic strips 74 is again relatively high to resist shock and vibrational forces.

Figure 8:
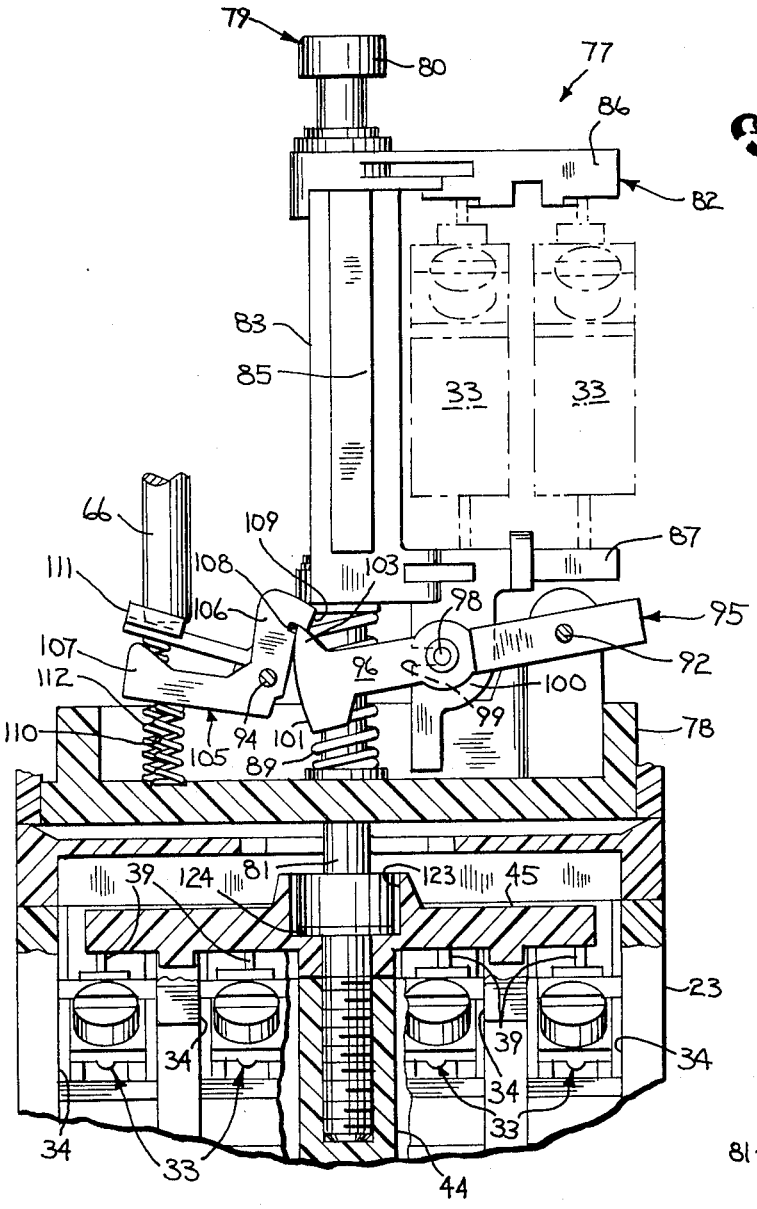
FIG. 8 is a sectional view taken in the plane indicated by lines 8—8 in FIG. 5 to show the latch in its restricted position, and to show the connection of the relay movement to the base relay.

Referring now to FIG. 5, a mechanical latch relay movement 77 is shown as a complete subassembly ready for insertion and mounting in the upper cartridge housing 25 with the solenoid 49. The relay movement 77 is built on a base 78 around an elongated operating plunger 79. The plunger 79 has a slotted head 80 at its upper end and a cylindrical shaft 81 that extends downward through the base 77, as seen in FIGS. 8 and 9.

Figure 6:
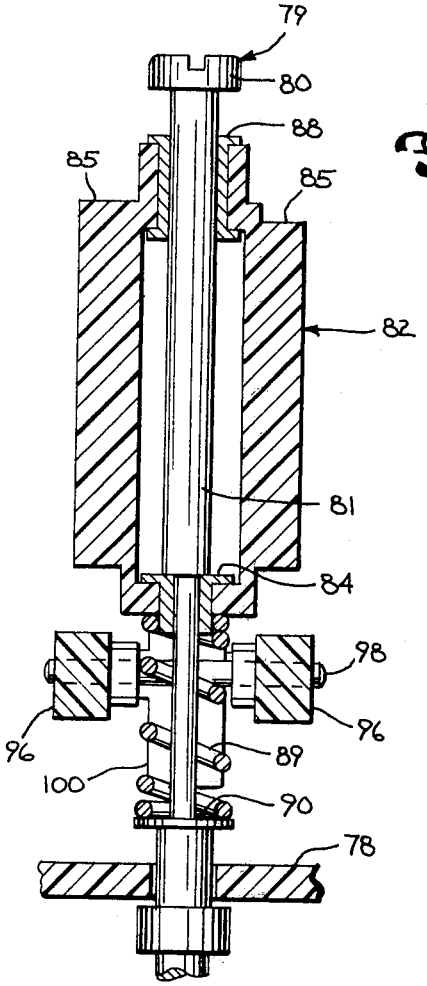
FIG. 6 is a sectional view taken in the plane indicated by lines 6—6 in FIG. 5.
Figure 9:
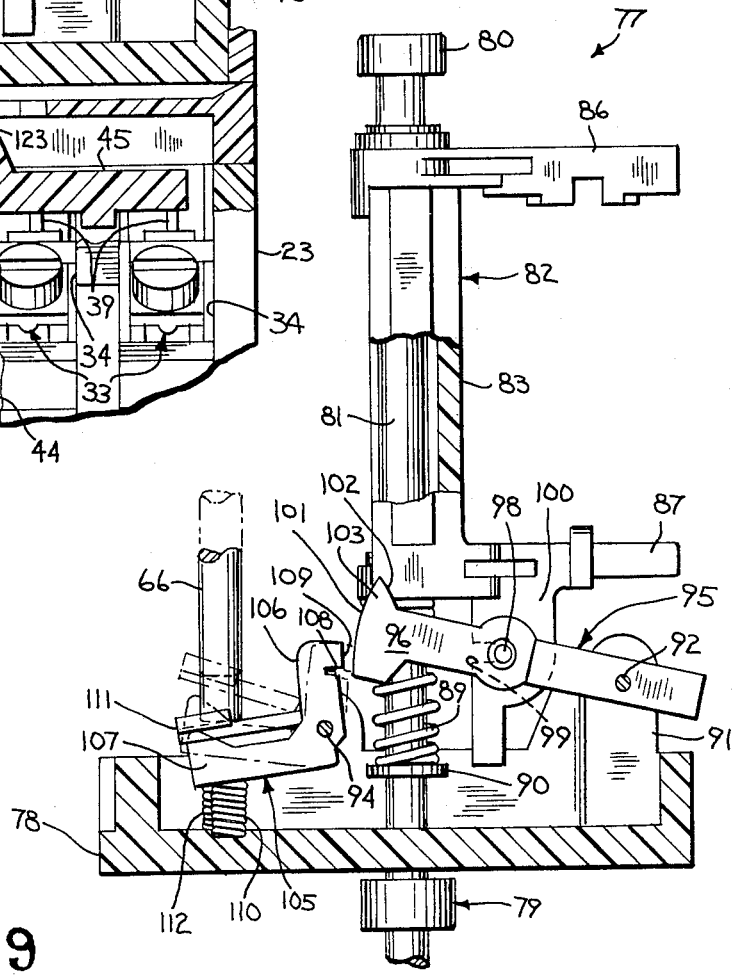
FIG. 9 is a sectional view taken in the same plane as FIG. 8 to show the release of the latch from its restriction.

Referring now to FIGS. 5, 6 and 9, the relay movement 77 has a contact actuator 82 with an elongated, vertical, box-shaped body 83. The actuator body 83 has two vertical side walls, seen in FIG. 5, and a vertical back wall, seen in FIG. 9, that surround the plunger shaft 81 on three sides. The shaft 81 extends through an open cavity between upper and lower ends of the actuator body 83 which encircle the shaft 81, the lower end of the actuator body 83 being fastened to a constricted portion of the shaft 81, as seen in FIG. 6. A sleeve 84 with a flange is seated in the lower end of the actuator body 83 and encircles the constricted portion of the shaft 81. The flange prevents the shaft 81 from sliding downward with respect to the actuator body 83. The actuator body 83 also has longitudinal ribs 85 formed on the exterior of its opposite sides, one rib 85 being slightly shorter than the other. Extending horizontally from the ends of the actuator body 83, and radially outward from the shaft 81, are a pair of vertically spaced links 86, 87. A bearing sleeve 88 in the upper link 86 surrounds the plunger shaft 81, the upper link 86 being pivotable about the vertical axis of the plunger 79. The bearing sleeve 88 is, however, fitted tightly to the actuator body 83 and the upper link 85, to prevent the upper link 86 from pivoting too easily.

As seen in FIG. 6, a high-compression spring 89 is mounted on the constricted portion of the shaft 81 beneath the actuator body 83. The upper end of the spring 89 encircles an extending portion of the sleeve 84 seated in the lower end of the actuator body 83. The high-compression spring 89 is captured between the lower end of the actuator body 83 and a flange 90 that encircles the shaft 81 below the spring 89. As the shaft 81 moves upward, the flange 90 will bear against the high-compression spring 89, which will transmit the force to the bottom of the actuator body 83. The spring 83 has a sufficiently high rate of compression so that it acts as a rigid member when normal operating forces are applied to it through the shaft 81. Only when an abnormal shock force is applied to the operating shaft 81, will the spring 89 be compressed to absorb a part of the force.

Referring again to FIG. 5, the relay movement 77 has a latch mechanism formed by parts arranged on the base 78 around the plunger 79. The base 78 has a first pair of spaced supports 91, with a first pivot pin 92 therebetween, located on one side of the plunger 79, and a second pair of spaced supports 93, holding a second pivot pin 94 therebetween, on the other side of the plunger 79. A yoke-shaped latch 95, made of an acetal resin, has a pair of spaced latch arms 96 joined together by a pair of cross members 97. The latch 95, which is stippled in FIG. 5 for better visibility, is pivotably mounted on the first pivot pin 92 with its arms 96 extending forward to a coupled connection with the contact actuator 82. As seen in FIGS. 6, 8 and 9, a coupling pin 98 is connected between the latch arms 96 and rides in a horizontal slot 99 formed in a coupling member 100 that depends from the lower contact actuator link 87 between the latch arms 96. This connection allows the latch 95 to pivot, while the contact actuator 82 is being moved linearly up and down. Referring now to FIGS. 5, 10 and 11, the latch arms 96 each extend forward from this coupled connection to a traveling end that is rotated about the first pivot pin 92. This end has a convex cam surface 101 facing the second pivot pin 94, with a dimension from top to bottom that is greater than the thickness of the main portion of the latch arm 96 that supports it. A convex mating surface 102 extends slightly forward from the top side of each latch arm 96 until it converges with the cam surface 101 formed forward of it, to form an upwardly projecting latch tooth 103, having a fine-edged cusp 104.

The latch arms 96 extend toward a pair of pawls 105, that are pivotably mounted on the second pivot pin 94 and spaced so that each pawl 105 is aligned with a respective latch arm 96. The pawls 105 are L-shaped, each having its pivot at a junction of a pair of radially extending fingers 106, 107. One finger 106 extends in a generally upward direction and has a hooked end that curves around a notch 108, as seen best in FIG. 11. The hooked finger 106 of each pawl 105 is terminated in a cam surface 109, which is formed on a blunted portion of the hooked end that faces the latch arm 96 associated with that pawl 105. Each pawl 105 also includes a radially extending trigger finger 107 that extends in a generally horizontal direction toward the end of the base 78 opposite from the latch pivot. The pawls 105 are biased to rotate toward the latch arm 96 by bias springs 110 located beneath the undersides of the trigger fingers 107 on the base 78. The pawls 105 are made of nylon, which together with the material of the latch 95, provides a lower coefficient of friction then is available with other materials that could be used for these components. A spanner member 111 is also pivotably mounted on the second pivot pin 94 between the pawls 105, and has laterally extending trip ends that overhang the trigger fingers 107. A spanner return spring 112 between the spanner 111 and the base 78 holds the spanner 112 in a raised position above the trigger fingers 107.

The latch 95 has a lever ratio that is designed to lessen the wear that tends to occur on the latch teeth 103 and the pawls 105 which engage one another. To reduce the force between these components, the latch 95 is arranged with a ratio of approximately 1:2 between the distance from its mounting on the first pivot pin 92 to its coupling with the actuator coupling member 100, and the distance from its mounting on the first pivot pin 92 to the ends of the latch arms 96. This lever ratio produces forces between the latch teeth 103 and the pawls 105 that are approximately half of the force exerted on the operating plunger 79.

Other wear preventive features have also been incorporated in the latch-and-pawl mechanism. The area of engagement between the latch 96 and the pawls 105 has been maximized by providing two latch arms 96, which are concurrently engaged by a pair of pawls 105. The ends of the latch arms 96 are enlarged to provide a greater area of contact between the latch 96 and the pawls 105. The greater contact area, of course, distributes the forces applied to the contact surfaces. Referring to FIG. 10, the cam surface 101 on each latch arm 96 has a curvature which substantially matches its path of travel 113 about the latch pivot. The convex mating surface 102 on each latch arm 96 has a center of curvature at the pivot pin 94 that mounts the pawl 105 opposite its supporting latch arm 96. The notch 108 on each of the pawls 105 forms a concave, arcuate surface of the same curvature as the convex surface 102 on the back of the latch tooth 103 that is engaged by that pawl 105. The cam surfaces 109 on the pawls 105 are substantially, but not exactly, parallel to the cam surfaces 101 on the latch arms 96. The arc of the latch cam surfaces 101 is gradual so that, over its short distance, a flat pawl cam surface 109 will be substantially parallel to an arcuate latch cam surface 101. Thus, each latch arm 96 and its associated pawl 105 have mating surfaces that are defined by a radius 114 from the pawl pivot pin 94, and cam surfaces which substantially match the path of travel defined by a radius 115 from the latch pivot pin 92.

Referring now to FIGS. 3 and 4, the relay movement 77, with the latching mechanism just described, can be inserted into the chamber 69 in the upper cartridge housing 25 from the bottom, when the cartridge housing 25 is detached from the control relay 21. Above this chamber 69, a pair of contact cartridge compartments 34 are formed, which are identical to the cartridge compartments 34 are formed in the lower cartridge housing 23. As seen in FIG. 2, these cartridge compartments 34 are formed by the central rib 47, an intermediate rib 116, and a vertical sidewall 117, which are all parallel and spaced apart from one another. The intermediate rib 116 has a vertical gap 118 as seen in FIGS. 2 and 4. The horizontal partition 68 seen in FIG. 3 on the solenoid side of the cartridge housing 25 is thicker on the cartridge compartment side of the cartridge housing 25, as seen in FIG. 4. The partition 68 forms a floor for the cartridge compartments 34 and has a vertical passageway 119 extending from the cartridge compartments 34 to the chamber 69 below. This passageway 119 is aligned with the gap 118 in the intermediate rib 116, and with the opening 48 in the central rib 47.

The relay movement 77 is inserted into the chamber 69 in the upper cartridge housing 25 with the actuator links 86, 87 being moved upward through passageway 119 and the rib openings 48, 118 to the position shown in FIGS. 2 and 4. The base 78 of the relay movement 77 has apertures 120 in its corners, shown in FIG. 5, through which mounting screws 121 extend to hold the relay movement 77 in place as shown in FIG. 4. The actuator body 83 fits within the vertical opening 48 in the central rib 47 shown in FIG. 2. In this position each of the longitudinal actuator ribs 85 is snugly received in sliding engagement with a mating mutual groove 122 formed in the central rib 48. The contact actuator 82 is thus guided for vertical movement and restrained from rotation as it moves with the plunger 79. With the relay movement 77 fastened in the upper cartridge housing 25, the assembly can be mounted on the control relay 21. As seen in FIG. 8, the lower end of the operating shaft 81 has a threaded portion that is received in the neck 44 of the drive yoke 31 through a vertical bore 123 in the cross bar 45. The operating shaft 81 also has a portion of enlarged cross section that is received together with a washer 124 in the bore 123 in the cross bar 45. The head 80 of the plunger 79 is rotated with the end of a common screwdriver to secure the connection. The mounting screws 26 are then inserted to fasten the upper cartridge housing 25 to the lower cartridge housing 23, as shown in FIG. 1.

To complete the assembly of the mechanical latch relay a cartridge compartment cover 125 seen in FIG. 2 is removed, and the upper actuator link 86 is pivoted 90° in a clockwise direction to overlie the shorter actuator rib 85 and the central housing rib 47. The entry to the cartridge compartments 34 in the upper cartridge housing 25 is now free of any overhanging obstruction, and the contact cartridges 33 can be dropped into place. Upon insertion of the cartridges 33 the upper actuator link 86 is moved back into the position shown in FIGS. 2, 4 and 8, and the cartridge compartment cover 125 is attached with mounting screws 126 to the upper cartridge housing 25. Now the operating stems 39 in these cartridges 33 are entrapped snugly between the upper and lower actuator links 86, 87 so that vertical movement of the contact actuator 82 will effect the same kind of "positive drive" contact actuation as is effected in the base relay 21. The cartridge compartment cover 125 can then be reattached to the upper cartridge housing 25 with the slotted plunger head 80 being received in a port formed by a circular flange 127 formed on the cover 123. The cartridge compartment cover 125 also includes depending studs 128 that hold the cartridge cases 37 in place as the operating stems 39 are moved. The contact cartridges 33 in the upper cartridge housing 25 are identical to those in the lower cartridge housing 23, except that the cartridge 33 shown in FIG. 4 is positioned for normally closed operation.

The mechanical latch relay can be mounted for operation by fastening a pair of brackets 129, formed on opposite sides of the magnet housing 22, as seen in FIGS. 1 and 2, to a supporting surface. The figures in the drawings have been oriented for an upright appearance on the drawing sheets, however, it should be understood that the control relay 21 and the apparatus of the present invention are normally disposed horizontally when mounted for operation.

OPERATION

The latching operation is effected through the downward movement of the operating plunger 79. The plunger 79 is moved downward when the coil assembly 28 in the primary electomagnet, seen in FIG. 4, is energized, or upon the manual depression of the plunger head 80, seen in FIG. 2. In either mode of operation, the combination of the armature 30, the drive yoke 31 and the plunger 79, is positively driven downward. This downward motion is conveyed, through the cross bar 45 and the upper actuator link 86, to the operating stems 39 of the contact cartridges 33 in the lower and upper cartridge housings 23, 25, respectively. The resulting operation of the relay movement 77 is seen in FIGS. 8 and 9. The downward movement of the plunger 79 pulls the latch 95 from a raised or open position, shown in FIG. 9, to a lower or closed position, shown in FIG. 8, in which the pawls 105 are pivoted forward under the urging of the bias springs 110 to restrict the latch 95. The hooked pawl fingers 106 slide over the cusps 104 of the latch teeth 103 to engage the latch teeth 103. The mating surfaces formed within the notches 108 of the hooked fingers 106 engage the mating surfaces 102 formed on the latch teeth 103. The mating connection is secured when the coil assembly 28 is deenergized, or when the manual force is removed, which allows the armature return springs 32 to exert an upward force on the latch 95 through the plunger 79.

During the latching movement, the slot 99 in the actuator coupling member 100 allows the coupling pin to slide as the latch 95 pivots. This lost motion connection permits the latch 95 to pivot while the contact actuator 82 moves linearly up and down. The spanner member 111 is held off the pawl trigger fingers 107 by the spanner return spring 112. The solenoid armature shaft 66 is held in a raised position by the attractive force provided by the magnetic strips 74 and by the spring force provided by the spanner return spring 112, as shown best in FIG. 3.

With the latch mechanism closed as shown in FIG. 8, the contact cartridges 33 in the two cartridge housings 23, 25 will remain actuated even if the coil assembly 28 is deenergized, or the manual operating force is removed. The closed latch mechanism will also continue to hold the relay armature 30 in its closed position.

The relay is unlatched as follows. The solenoid armature 62 in FIG. 3 is moved downward against the forces provided by the magnetic strips 74 and the spanner return spring 112, to move the armature shaft 66 downward as shown in FIG. 9. This is accomplished by energizing the solenoid through its terminals 76, or by manually depressing the solenoid armature 62, through the rectangular aperture 73 in its cover 72 shown in FIG. 2, with a suitable tool such as a screwdriver. In either mode of operation, the armature shaft 66 moves against the spanner member 111, which in turn is moved against both pawl trigger fingers 107, as seen in FIGS. 9 and 10. At this point in the stroke of the armature shaft 66, the armature return spring 70 begins to provide a load, however, the combined load provided by the magnetic strips 74 and the spanner return spring 112 is at a low point, the armature 62 thus providing a maximum force to begin moving the pawls 105. The pawls 105 are pivoted against their bias springs 110 and out of the position restricting the latch arms 96. The pawls 105 are pivoted about the second pivot pin 94, so that the concave mating surfaces formed in the notches 108 slide off the latch teeth 103 parallel to the convex mating surfaces 102. The position of the latch 95 at the beginning of this release action is shown by the figure in solid lines in FIG. 10.

The release of the latch 95 releases the plunger 79, the contact actuator 82, the drive yoke 31 and cross bar 45, and the relay armature 30. The relay armature 30 moves to its open position, shown in FIG. 4, under the urging of its return springs 32, and ceases actuation of the contacts 35, 36 within both cartridge housings 23, 25. At this point in the release operation the latch 95 is in the position shown in solid lines in FIG. 9. The solenoid 49 is only momentarily energized, or manually depressed, to obtain the release, and upon its deenergizing or manual release, the armature shaft 66 is returned to its starting position, shown in phantom in FIG. 9, by the force provided by the armature and spanner return springs 70, 112. The spanner 111 is pivoted upward, off the trigger fingers 107, by the spanner return spring 112, and returns to a position that is also shown in phantom in FIG. 9. The hooked ends of the pawls 105 are then pivoted forward under bias, as shown in phantom in FIGS. 9 and 10, so that their cam surfaces 109 engage the latch cam surfaces 102 while the latch is in raised or open position. In this position the pawls 105 and the latch arms 96 move slidably against each other until the latch 95 is again moved to its closed position as shown in FIG. 8.

A latch-and-pawl mechanism of the type just described has unusually good wear resistance in a mechanical latch relay. It is not known precisely why this wear resistance occurs, however, it does occur. A mechanical latch relay of this type was cycled through ten million operations with wear on the latch teeth 103 and pawls 105 that reduced their size as shown generally by the phantom lines in FIG. 11. Although the size of the latch teeth 103 was reduced, the sharpness of the cusps 104 was maintained, thereby insuring an effective operation. Wear on the cam surfaces 109 of the pawls 105 resulted in only a slight shortening of the fingertips that extend toward the latch 95.

The operation of a mechanical latch relay is somewhat different from the operation of a time delay relay of the type disclosed in U.S. Pat. No. 4,179,676, mentioned above. With the contact actuator 82 and the upper cartridge housing 25 fastened to the plunger 79, the latch mechanism in the mechanical latch relay holds the relay armature 30 and the relay contacts 35, 36 in the lower cartridge housing 23 in a closed or actuated position, as well as maintaining the actuation of contacts 35, 36 in the upper cartridge housing 25. This type of latching operation provides greater forces upon the latch mechanism than in a time delay relay. The operation of the two pawls 105 doubles the surface area of the latch engagement when the latch 95 is in a closed position. The two pawls 105 also provide balanced restraining forces on the two latch arms 96.

The solenoid 49 of the present invention operates through an armature shaft 66 that resembles the operation of the pneumatic timer output member in the time delay relay. The operating constraints of a pneumatic timer, however, are not normally placed upon a solenoid. As a consequence of these constraints, the solenoid 49 of the present invention incorporates several special features. The armature 62 is comprised of several flat plates 63, 64 of ferromagnetic material and an armature shaft 66 of a non-ferromagnetic material. Magnetic strips 74 have been incorporated to hold the solenoid armature 62 in its open position without contributing a significant force at other positions. If this holding force were provided by the armature return spring 70 or the spanner return spring 112, the solenoid 49 would have to be made larger to provide an added closing force when energized. The solenoid yoke-and-coil assembly has been partially encapsulated in a block of insulating material 58, which includes a passageway 61 with a segment of rectangular cross section. The passageway 61 accommodates a portion of the solenoid armature shaft 66 of rectangular cross section to prevent the armature 62 from rotating.

In normal operation the high-compression spring 89 mounted on the plunger 79 between the base 78 and the contact actuator 82 of the relay movement 77 is inoperative. In the event that a mechanical latch device 20 is assembled to a control relay 21 during shipment, this spring 89 provides protection for the relay movement 77. The relay armature 30 is quite heavy in relation to the parts employed in the relay movement 77. If the armature 30 were to be jarred open during shipment, the plunger 79 might be moved upward with such force as to damage the relay movement 77. In these circumstances the high-compression spring 89 will absorb the shock and protect the relay movement 77. In normal operation, however, the high-compression spring 89 acts as a substantially rigid member having no effect on the operation of the relay.

What has been described is a compact mechanical latch device with subassemblies and components that can be interchanged with subassemblies and components in a time delay device. This interchangeability provides substantial economies in manufacturing. The mechanical latch mechanism is a one-piece assembly with plastic components that resist wear that would interfere with their operation. The relay movement operates a pair of auxiliary contact cartridges which can be fitted in a cartridge housing with the relay movement and the solenoid of the present invention. The relay movement is also provided with a shock-absorbing spring to protect its components during shipment and other handling outside its normal operation.

The embodiments of the invention in which an exclusive property or privilege is claimed are defined as follows:

1. In a mechanical latch device having an elongated operating plunger that is longitudinally movable between first and second positions to actuate and deactuate a set of contacts, the combination with said plunger of:

a latch that includes a pair of spaced arms each having a free end on which a respective latch tooth is formed;

a contact actuator having upper and lower spaced links mounted on said plunger, said actuator links extending radially from said plunger and being adapted to be coupled to said contacts for actuation and deactuation, said contact actuator also having a member depending from said lower actuator link and coupled to said latch for moving said latch with said plunger between its first, contact-actuating position and its second, contact-deactuating position;

a pair of spaced apart catches, each catch being disposed opposite the free end of a respective latch arm, each catch having a trigger portion extending away from its associated latch arm and each catch having a hooked end that is adapted to move along an arcuate path to and from a position where the hooked end restricts a respective latch tooth when said latch is moved to the contact-actuating position by said plunger;

a spanner extending across the space between said catches, said spanner having trip ends disposed in position to move the trigger portions of said catches to release said latch; and an electromagnet with an armature that is operable upon the energization of said electromagnet to move said spanner and catches to release said latch and plunger to allow their movement to the contact-deactuating position.

2. In a mechaical latch device having an elongated operating plunger that is longitudinally movable between first and second positions, the combination with said plunger of:

a yoke-shaped latch having a pair of spaced arms, each latch arm having a free end on which a tooth is formed, said latch being disposed with said plunger passing between said latch arms;

a contact actuator, fastened to said plunger and extending therefrom to a coupled connection to said latch, said contact actuator moving said latch with said plunger between first and second latch positions corresponding to a first, contact-deactuating position and a second, contact-actuating position of said plunger; and a pair of spaced pivotable pawls, each disposed opposite the toothed end of a respective latch arm, and each biased to pivot to a position restricting the return movement of the tooth on its associated latch arm when said latch is moved to its contact-actuating position, whereby a balanced, wear-resistant latch device with dual engagement is provided.

3. In a mechanical latch device having an elongated operating plunger that is longitudinally movable between first and second positions, the combination with said plunger of:

a yoke-shaped latch having a pair of spaced arms, each latch arm having a free end on which a tooth is formed of an acetal resin, said latch being disposed with said plunger passing between said latch arms;

connection means, fastened to said plunger and coupled to said latch, for moving said latch with said plunger between first and second latch positions corresponding to the first and second positions with said plunger; and a pair of spaced, pivotable pawls, each having a portion made of nylon that is adapted to restrict the toothed end of the respective latch arm, and each pawl being biased to pivot to a position restricting the return movement of said latch when said latch is moved to its second position.

4. In a mechaical latch device having an elongated operating plunger that is longitudinally movable between first and second positions, the combination with said plunger of:

a yoke-shaped latch having a pair of spaced arms, each latch arm having a free end on which a tooth is formed, said latch being disposed with said plunger passing between said latch arms;

connection means, fastened to said plunger and coupled to said latch, for moving said latch with said plunger between first and second latch positions corresponding to the first and second positions of said plunger; and a pair of spaced, pivotable pawls, each disposed opposite the toothed end of a respective latch arm, and each biased to pivot to a position restricting the return movement of said latch when said latch is moved into its second position, wherein each latch tooth is formed by a convex cam surface on the free end of its respective latch arm, said convex cam surface facing the pawl associated with that latch arm, and by a convex mating surface that converges toward said convex cam surface from an intermediate point along the latch arm on which the tooth is formed; and wherein each pawl has a hooked finger with a cam surface on its tip that is adapted to engage the cam surface on an associated latch arm as said latch is moved between its first position and its second position, each finger also having a notch adjacent to said cam surface in which a concave mating surface is formed, said concave mating surface being adapted to engage the convex mating surface on an associated latch tooth when said latch is in its second position.

5. The combination of claim 4, wherein the mating surfaces formed on each pawl and its associated latch arm have the same curvature, with a center of curvature at the pivot for that pawl.

6. The combination of claim 4, wherein:

said latch is pivotable; and wherein said cam surfaces formed on said latch arms are substantially parallel to the path of travel of the free end of said latch.

7. In a relay movement having an operating shaft that is longitudinally movable in forward and reverse directions, a latch, and a catch for restricting said latch, the combination comprising:

connection means, encircling said shaft and extending to a coupled connection with said latch;

first and second flanges carried by said shaft and spaced longitudinally therealong on opposite sides of said connection means; said first flange being adapted to move said connection means as said shaft moves forward to move said latch to a position in which it is restricted by said catch;

a spring mounted between said second flange and said connection means, said spring yielding to protect said latch and said catch from shock forces exerted on said shaft in the reverse direction when said latch is restricted by said catch, and said spring being substantially unyielding during unrestricted movement of said shaft.

8. An electromagnet for a mechanical latch device to release a latch held therein, the electromagnet comprising:

a pair of energizing coils connected together;

a pair of terminals each connected to a respective energizing coil;

a U-shaped yoke having a base portion and two legs extending from opposite ends of said base portion to an end on which a pole face is formed, each leg having a respective coil encircling it, said yoke and said coils being encapsulated in a block of insulating mterial except for said pole faces, said terminals also extending outside said insulating block, said insulating block having a passageway extending therethrough between said yoke legs and through said base portion of the yoke;

a T-shaped armature having a cross piece of magnetic material spaced from said pole faces on one side of said insulating block, and a shaft of nonmagnetic material extending through said passageway to the other side of said insulating block; and a return spring encircling said armature shaft between said insulating block and said armature cross piece.

9. The combination of claim 8, wherein said electromagnet includes a cover that partially encloses said armature, said armature providing a manual release operation.

10. The combination of claim 8, wherein said electromagnet includes a cover, and a pair of magnetic strips mounted inside said cover to hold the armature in its open position when said energizing section is deenergized.

11. The combination of claim 8, wherein said passageway has a portion with a rectangular cross section and wherein said armature shaft also has a portion with a rectangular cross section to prevent the armature from rotating.

12. In a mechanical latch device, the combination comprising:

a housing having first and second compartments spaced apart;

a contact cartridge disposed in said first compartment, said cartridge including a set of contacts and a slidable operating stem for actuating said contacts;

a mechanical latch movement disposed in said housing between and beneath said compartments and including:

an elongated plunger disposed between said compartments for longitudinal movement through said housing;

a contact actuator mounted on said plunger and extending radially from the longitudinal axis of said plunger to a coupled connection with said contact cartridge stem;

a latch coupled to said contact actuator for movement with said plunger;

catch means disposed beneath said second compartment for restricting said latch upon its movement with said plunger to a position in which said contacts are actuated; and an electromagnet disposed in said second compartment and including:

an energizing section with two pole faces;

an armature having a cross piece spaced from said pole faces and a shaft of that extends from said cross piece through said energizing section, said shaft having an end that is adapted to be moved beneath said second compartment upon the closing of said armature against said pole faces, and that is further adapted to move said catch means to release said latch; and spring means for urging said armature apart from said pole faces the latch has been released and the force closing the armature has been removed.

* * * * *

UNITED STATES PATENT AND TRADEMARK OFFICE

CERTIFICATE OF CORRECTION

PATENT NO. : 4,250,477

DATED : February 10, 1981

INVENTOR(S) : Frank J. Graninger and Robert J. Frey

It is certified that error appears in the above—identified patent and that said Letters Patent is hereby corrected as shown below:

Column 3, line 41 - after the word "are" insert --each--

Column 5, line 47 - "BRIED" should be --BRIEF--

Column 5, line 61 - "the" should be --a--

Column 6, line 41 - "to" should be --two--

Column 8, line 38 - "5" should be --52--

Column 9, line 53 - "allow" should be --allows--

Column 10, line 41 - "83" (second occurrence) should be -- 89 --.

Column 16, line 44 - "mechaical" should be --mechanical--

Column 17, line 19 - "mechaical" should be --mechanical--

Column 20, line 8 - after the word "faces" insert -- when --.

Signed and Sealed this

*Twelfth* Day of *May 1981*

[SEAL]

*Attest:*

RENE D. TEGTMEYER

*Attesting Officer* *Acting Commissioner of Patents and Trademarks*